US008430015B2

(12) United States Patent
Faifer

(10) Patent No.: US 8,430,015 B2
(45) Date of Patent: Apr. 30, 2013

(54) FIREARM BUFFER TUBE

(76) Inventor: Sagi Faifer, Mishmar Hashiva (IL)

( * ) Notice: Subject to any disclaimer, the term of this patent is extended or adjusted under 35 U.S.C. 154(b) by 93 days.

(21) Appl. No.: 12/552,318

(22) Filed: Sep. 2, 2009

(65) Prior Publication Data

US 2010/0050492 A1 Mar. 4, 2010

Related U.S. Application Data

(60) Provisional application No. 61/094,077, filed on Sep. 4, 2008.

(51) Int. Cl.
*F41A 25/14* (2006.01)

(52) U.S. Cl.
USPC ..... 89/44.01; 89/198; 42/73; 42/74

(58) Field of Classification Search ..... 89/44.01, 89/44.02, 198; 42/74, 73
See application file for complete search history.

(56) References Cited

U.S. PATENT DOCUMENTS

| | | | | |
|---|---|---|---|---|
| 311,755 | A * | 2/1885 | Hermle | 42/74 |
| 640,541 | A * | 1/1900 | Dawson et al. | 89/44.01 |
| 2,249,310 | A * | 7/1941 | Braun et al. | 89/44.01 |
| 2,831,404 | A * | 4/1958 | Sampson et al. | 89/198 |
| 3,105,411 | A * | 10/1963 | Browning | 89/177 |
| 7,681,351 | B2 * | 3/2010 | Bucholtz et al. | 42/1.06 |
| 7,793,453 | B1 * | 9/2010 | Sewell | 42/73 |
| 2006/0236853 | A1 * | 10/2006 | Boersching et al. | 89/198 |
| 2008/0110074 | A1 * | 5/2008 | Bucholtz et al. | 42/1.06 |

* cited by examiner

*Primary Examiner* — Stephen M Johnson
(74) *Attorney, Agent, or Firm* — Deborah Gador

(57) ABSTRACT

A buffer tube for a firearm, which is not an M16-type firearm, the buffer tube including a recoil mitigation tube, a recoil piston reciprocatingly mounted inside the recoil mitigation tube, and a recoil absorbing mechanism disposed in the recoil mitigation tube and engaging the recoil piston.

10 Claims, 5 Drawing Sheets

FIREARM BUFFER TUBE

RELATED APPLICATIONS

This application claims the benefit of U.S. Provisional Application No. 61/094,077 filed 4 Sep. 2008.

FIELD OF THE INVENTION

The present invention relates to buffer tubes for firearms, in general and, in particular, to a replacement buffer tube for a firearm having strong recoil that is not an M16.

BACKGROUND OF THE INVENTION

Firearms, which are not M16, are provided with a stock which is very often replaced due to weight and shape. Since different receivers are designed and built by different manufacturers, mounting a replacement stock on the receiver of a firearm generally requires adapting the stock to the receiver, for example, sanding down the stock until it fits in the cavity of the receiver. In another example, a conventional stock is inserted under the locking tang of the receiver. The user must drill holes in the stock in accordance with the location of the screw holes in the tang, in order to affix the replacement stock to the receiver.

In addition, very often the stock is replaced with a plastic M16 stock, in which case the original buffer tube of the firearm on which it is mounted must be replaced. In the M16, the buffer tube holds part of the mechanism of the firearm. However, firearms which are not M16, such as AK's, do not utilize the M16 mechanism inside the buffer tube, and so a hollow buffer tube is used in the replacement stock merely to hold the stock on the receiver.

Accordingly, there is a long felt need for a stock having an easily adjustable mounting member, and it would be very desirable for the buffer tube holding the stock to serve an additional function, rather than merely holding the stock.

SUMMARY OF THE INVENTION

There is provided, according to the present invention, a buffer tube for a firearm, which is not an M16-type firearm, the buffer tube including a recoil mitigation tube, a recoil piston reciprocatingly mounted inside the recoil mitigation tube, and a recoil absorbing mechanism disposed in the recoil mitigation tube and engaging the recoil piston.

In a preferred embodiment of the present invention, the recoil absorbing mechanism is a spring.

According to another embodiment, the buffer tube further includes a mounting member coupled to the recoil piston. The mounting member includes a locking tang for adjustably receiving a tang of a receiver.

Further according to embodiments of the invention, the mounting member further includes an adapter for mounting the mounting member in a receiver of a firearm. The adapter includes a pair of arms adapted to engage the inner walls of the receiver.

There is also provided, according to the present invention, a method for forming a buffer tube for a firearm which is not an M16 type, the method including providing a recoil mitigation tube, disposing a recoil absorbing mechanism in the recoil mitigation tube, and reciprocatingly mounting a recoil piston inside the recoil mitigation tube engaging said recoil absorbing mechanism.

BRIEF DESCRIPTION OF THE DRAWINGS

The present invention will be further understood and appreciated from the following detailed description taken in conjunction with the drawings in which.

DETAILED DESCRIPTION OF THE INVENTION

Figure 9:
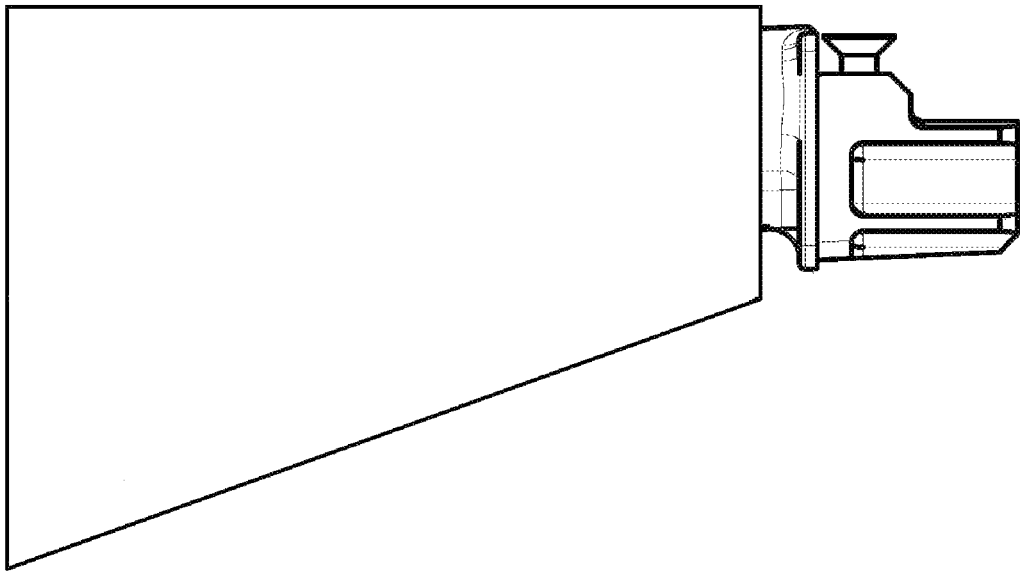
FIG. 9 is a side view of the buffer tube of FIG. 1 with a schematic stock mounted thereon.

The present invention relates to a replacement buffer tube for a firearm, which is not an M16 type firearm. The buffer tube according to the present invention allows mounting of a standard replacement M16 stock thereon, as shown in FIG. 9, and provides an adjustable recoil mitigation system. The buffer tube includes a mounting member for engaging the receiver of a firearm. Some embodiments include an adapter, which is particularly suitable for mounting the buffer tube on any AK type firearm. In particular, the buffer tube includes a recoil mitigation tube, a recoil piston reciprocatingly mounted inside the recoil mitigation tube, and a recoil absorbing mechanism inside the recoil mitigation tube engaging the recoil piston.

Figure 8:
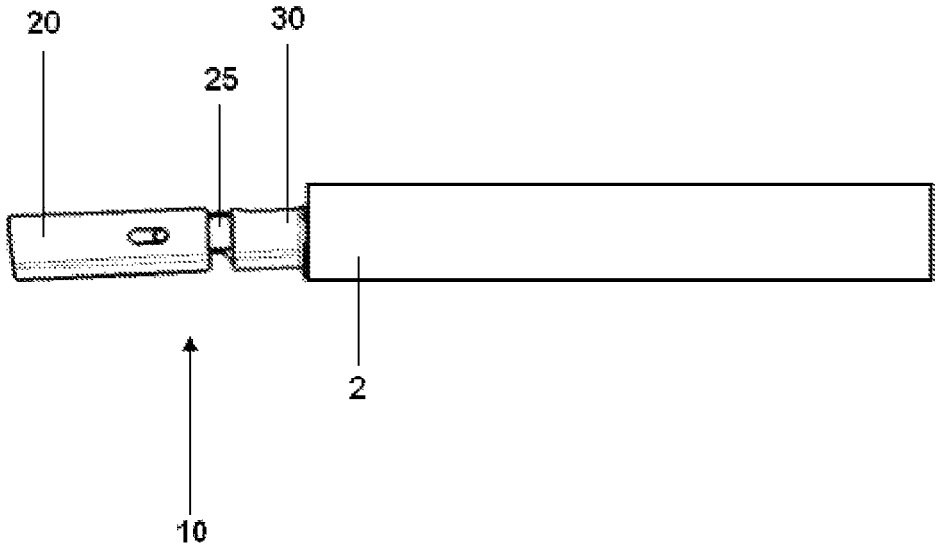
FIG. 8 is a side view of the buffer tube of FIG. 1 mounted on a schematic receiver of a firearm, by way of example only.

FIGS. 1-4 are side, top, front, and perspective views, respectively, of a buffer tube 10 constructed and operative according to one embodiment of the present invention. Buffer tube 10 is a two part buffer tube, and includes a recoil mitigation tube 20, which is a hollow cylindrical member having one partially closed end, and a recoil piston 25 reciprocatingly mounted therein. A recoil absorbing mechanism 24 is mounted in recoil mitigation tube 20. Recoil piston 25 is mounted for reciprocal motion in recoil mitigation tube 20 through opening 22. Recoil mitigation tube 20 further includes a stop groove 21. Recoil piston 25 includes a stop pin 29 adapted to slide inside groove 21 in the wall of recoil mitigation tube 20, so as to limit the movement of recoil piston 25. Buffer tube 10 further includes a mounting member 30, which is coupled to or integrally formed with recoil piston 25, for mounting the buffer tube on the receiver 2 of a firearm, as seen in FIG. 8.

Figure 1:
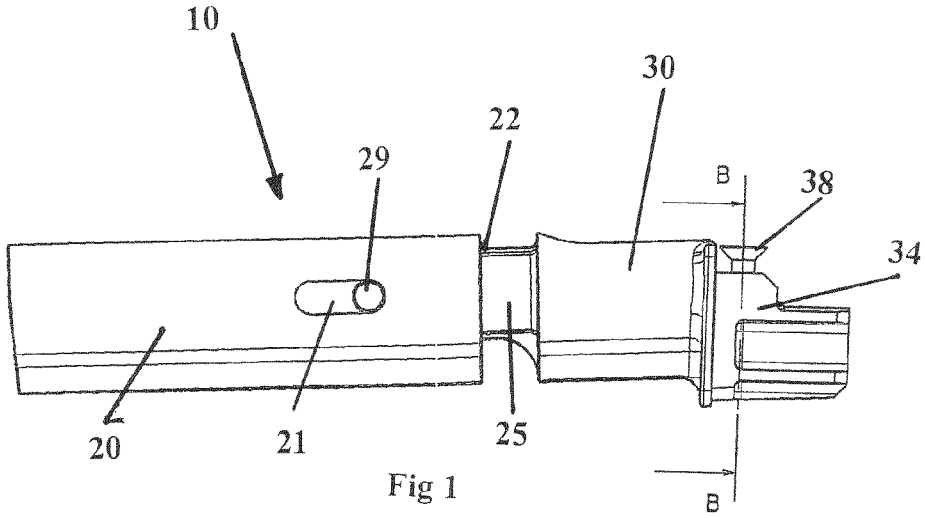
FIG. 1 is a side view illustration buffer tube constructed and operative in accordance with one embodiment of the present invention.
Figure 2:
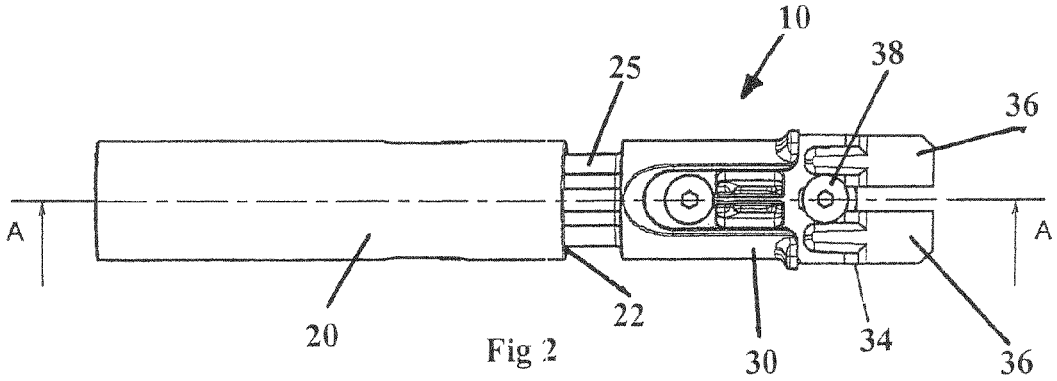
FIG. 2 is a top view illustration of the buffer tube of FIG. 1.
Figure 3:
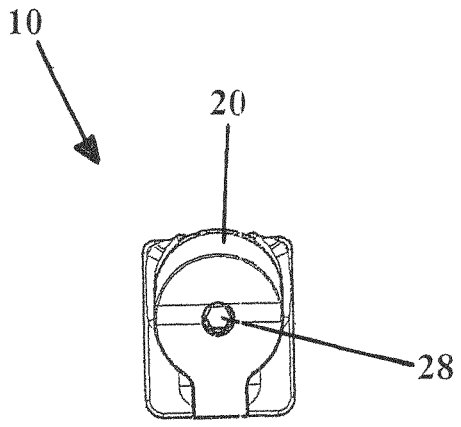
FIG. 3 is a front view illustration of the buffer tube of FIG. 1.
Figure 4:
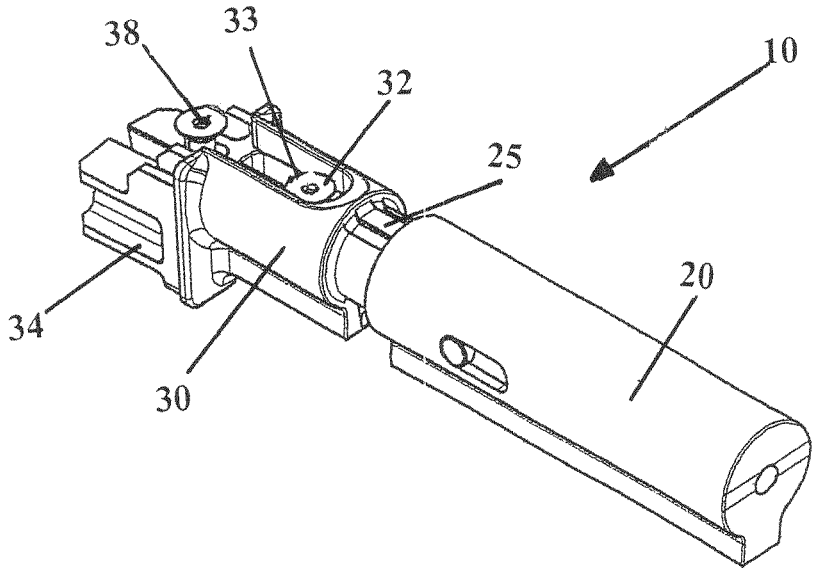
FIG. 4 is a perspective view illustration of the buffer tube of FIG. 1.
Figure 5:
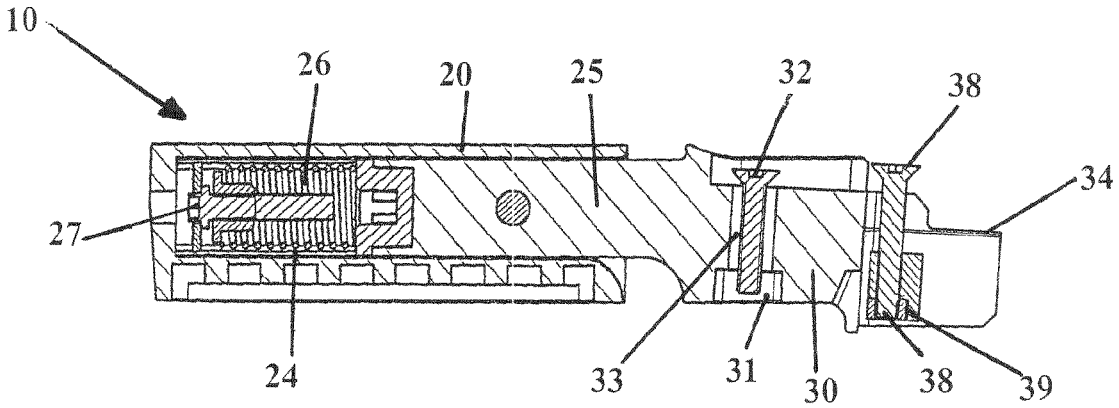
FIG. 5 is a side sectional illustration taken along line A-A of the buffer tube of FIG. 2.
Figure 6:
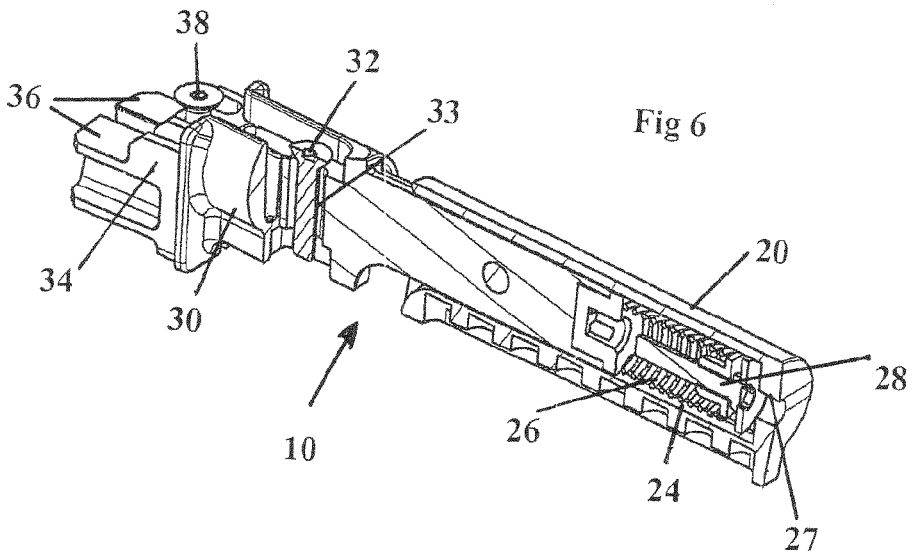
FIG. 6 is a partially cut away view of the buffer tube of FIG. 4.

FIGS. 5 and 6 are side sectional view and partially cutaway perspective view, respectively, of the buffer tube 10 of FIG. 1. According to this embodiment of the invention, the recoil absorbing mechanism 24 includes a spring 26 mounted in recoil mitigation tube 20 engaging recoil piston 25. Alternatively, the spring may be replaced with any other recoil absorbing mechanism. Preferably, means are provided for adjusting the degree of recoil absorption of mechanism 24, according to the desires of each user. In the illustrated embodiment, these means include an adjustable tension nut 27 mounted on a tension adjusting screw 28 (best seen in FIG. 3) for adjusting the tension of spring 24.

Mounting member 30 includes a mounting screw 32 in a mounting groove 33, for mounting the buffer tube in the receiver of a firearm. Mounting member 30 further includes an adapter 34 for firmly securing the buffer tube to the inner walls of the cavity of a receiver of any size. The adapter is smaller than the cavity in the receiver and is expandable to strongly engage the walls of the receiver.

Figure 7:
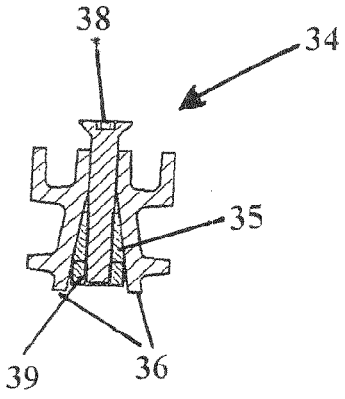
FIG. 7 is a sectional illustration taken along line B-B on FIG. 1.

Referring now to FIG. 7, there is shown a front sectional view of adapter 34. According to the illustrated embodiment, adapter 34 includes two arm members 36 extending sideward from mounting member 30, and defining a wedge-shaped space 35 therebetween. A locking screw 38, with a locking nut 39, is mounted in wedge-shaped space 35 between arms 36. As screw 38 is rotated, nut 39 is moved along wedge-shaped space 35, thereby pushing the two arm members 36 outwards, thereby increasing the distance between the lower portions of arms member 36 adjacent nut 39 and securing buffer tube 10 to the inner walls of the receiver.

According to alternative embodiments of the invention, adapter 34 includes external screw threads (not shown) complementary to screw threads in the receiver of the firearm.

Buffer tube 10 is coupled to the locking tang of the firearm extending from the receiver (not shown) by means of mounting screw 32, which is inserted through groove 33 and held in place by a nut 31. According to the present invention, the locking tang is moved relative to the mounting member 30, until the hole in the locking tang is aligned with the screw hole in groove 33. The position of mounting screw 32 and nut 31 can be adjusted in groove 33 until the tang can be firmly locked in place.

Recoil mitigation tube 20 provides additional mitigation to the firearm, which already includes a mechanism which mitigates the recoil, and may be adjusted so as to provide recoil mitigation in accordance with user preferences. Adjusting the tension of spring 26 may be carried out by positioning tension nut 27 closer to or away from recoil piston 25, so as to adjust the tension of spring 26. The position of tension nut 27 may be changed by rotating mitigation adjusting screw 28 (best seen in FIG. 3).

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A method for providing recoil mitigation for a firearm having a receiver, the method comprising:

providing a hollow, cylindrical recoil mitigation tube partially closed at one end configured for mounting a stock thereon;

disposing a recoil absorbing spring in said recoil mitigation tube in said closed end;

reciprocatingly mounting a recoil piston inside said recoil mitigation tube engaging said recoil absorbing spring; and providing a mounting member on said recoil piston configured for lockingly mounting the mounting member on the firearm receiver;

wherein the recoil mitigation tube and the piston are configured to permit motion of the receiver relative to the stock during firing;

forming a stop pin on said recoil piston;

forming a stop groove said recoil mitigation tube; and slidingly disposing said stop pin inside said stop groove, so as to limit movement of said recoil piston.

2. The method according to claim 1, further comprising:

forming on said mounting member an adapter for mounting said mounting member in the receiver of a firearm.

3. The method according to claim 1, further comprising adjusting a degree of recoil mitigation of said recoil absorbing spring.

4. A replacement buffer tube for a firearm having a receiver, the buffer tube comprising:

a hollow, cylindrical recoil mitigation tube partially closed at one end allowing mounting of a replacement stock thereon; and an adjustable recoil absorbing mechanism providing reciprocating motion between the receiver and said stock during firing, said mechanism including:

a recoil piston reciprocatingly mounted inside said recoil mitigation tube, said recoil piston including a mounting member configured for lockingly mounting on the firearm receiver so that the stock and the receiver move relative to one another during firing; and a recoil absorbing spring disposed in said recoil mitigation tube and engaging said recoil piston and configured to mitigate motion of the receiver relative to the stock during firing;

further comprising means for adjusting a degree of recoil mitigation of said recoil absorbing spring;

wherein said means for adjusting a degree of recoil mitigation includes an adjustable tension nut mounted on a tension adjusting screw coupled to said spring for adjusting the tension of said spring.

5. The buffer tube of claim 4, wherein said mounting member includes an adapter for lockingly mounting said mounting member in the receiver of a firearm.

6. The buffer tube according to claim 4, wherein said mounting member is integrally formed with said recoil piston.

7. A replacement buffer tube for a firearm having a receiver, the buffer tube comprising:

a hollow, cylindrical recoil mitigation tube partially closed at one end allowing mounting of a replacement stock thereon; and an adjustable recoil absorbing mechanism providing reciprocating motion between the receiver and said stock during firing, said mechanism including:

a recoil piston reciprocatingly mounted inside said recoil mitigation tube, said recoil piston including a mounting member configured for lockingly mounting on the firearm receiver so that the stock and the receiver move relative to one another during firing; and a recoil absorbing spring disposed in said recoil mitigation tube and engaging said recoil piston and configured to mitigate motion of the receiver relative to the stock during firing;

said recoil mitigation tube further includes a stop groove; and said recoil piston includes a stop pin slidingly disposed inside said stop groove, so as to limit movement of said recoil piston.

8. The buffer tube according to claim 7, further comprising means for adjusting a degree of recoil mitigation of said recoil absorbing spring.

9. The buffer tube of claim 7, wherein said mounting member includes an adapter for lockingly mounting said mounting member in the receiver of a firearm.

10. The buffer tube according to claim 7, wherein said mounting member is integrally formed with said recoil piston.

* * * * *